US012528633B2

(12) United States Patent
Rimon

(10) Patent No.: US 12,528,633 B2
(45) Date of Patent: Jan. 20, 2026

(54) DISPENSING RECEPTACLE AND BAG APPARATUS

(71) Applicant: Ronen Rimon, Jerusalem (IL)

(72) Inventor: Ronen Rimon, Jerusalem (IL)

( * ) Notice: Subject to any disclaimer, the term of this patent is extended or adjusted under 35 U.S.C. 154(b) by 180 days.

(21) Appl. No.: 18/395,808

(22) Filed: Dec. 26, 2023

(65) Prior Publication Data

US 2024/0166417 A1 May 23, 2024

Related U.S. Application Data

(63) Continuation-in-part of application No. 17/623,671, filed as application No. PCT/IL2020/050903 on Aug. 17, 2020, now abandoned.

(30) Foreign Application Priority Data

Sep. 1, 2019 (IL) ..... 269047

(51) Int. Cl.

| | |
|---|---|
| ***B65D 35/10*** | (2006.01) |
| ***B65D 51/22*** | (2006.01) |
| ***B65D 77/06*** | (2006.01) |
| ***B65D 83/00*** | (2006.01) |

(52) U.S. Cl.

CPC ..... *B65D 77/06* (2013.01); *B65D 35/10* (2013.01); *B65D 51/222* (2013.01); *B65D 83/771* (2025.01); *B65D 2577/041* (2013.01)

(58) Field of Classification Search

CPC .. B65D 77/06; B65D 35/10; B65D 2577/041; B65D 51/222; B65D 83/771

See application file for complete search history.

(56) References Cited

U.S. PATENT DOCUMENTS

| | | | | | |
|---|---|---|---|---|---|
| 2,876,113 | A * | 3/1959 | Barton | A61J 9/001 | 426/117 |
| 3,223,289 | A | 12/1965 | Bouet | | |
| 3,784,039 | A * | 1/1974 | Marco | A61J 9/001 | 264/525 |
| 3,938,706 | A * | 2/1976 | Cohen | B67D 7/0216 | 222/105 |
| 3,995,772 | A * | 12/1976 | Liautaud | B05B 11/048 | 222/83.5 |
| 4,469,250 | A * | 9/1984 | Evezich | B65D 83/771 | 222/83.5 |
| 4,657,151 | A * | 4/1987 | Cabernoch | B29D 23/20 | 215/11.4 |
| 4,706,827 | A * | 11/1987 | Cabernoch | B65D 71/0085 | 215/11.1 |

(Continued)

FOREIGN PATENT DOCUMENTS

| | | |
|---|---|---|
| AU | 4455893 | 10/1993 |
| CA | 2547135 A1 | 5/2005 |

(Continued)

*Primary Examiner* — Frederick C Nicolas

(74) *Attorney, Agent, or Firm* — AlphaPatent Associates Ltd.; Daniel J. Swirsky

(57) ABSTRACT

A dispensing receptacle (10), including a frame member (12A), a bag and lid member (12D), for being connected to the frame member (12A), the bag and lid member (12D) including a bag (18) for containing content (24), and an orifice (16) for dispensing the content (24) therethrough, thereby the content (24) does not dirty the frame member (12A).

9 Claims, 9 Drawing Sheets

(56) References Cited

U.S. PATENT DOCUMENTS

| | | | | | |
|---|---|---|---|---|---|
| 4,760,937 | A * | 8/1988 | Evezich | B65D 83/771 | 222/209 |
| 4,909,416 | A * | 3/1990 | Evezich | B65D 83/771 | 222/105 |
| 5,005,733 | A * | 4/1991 | Stoody | B65D 83/771 | 383/905 |
| 5,012,956 | A * | 5/1991 | Stoody | B65D 83/771 | 222/206 |
| 5,875,936 | A * | 3/1999 | Turbett | B05B 11/0094 | 222/536 |
| 6,564,970 | B1 * | 5/2003 | Walch | B05C 17/00586 | 222/386 |
| 8,464,908 | B1 | 6/2013 | Tabor | | |
| 2007/0138207 | A1 * | 6/2007 | Bonney | B05B 11/1052 | 604/246 |
| 2009/0057347 | A1 | 3/2009 | Leys | | |
| 2010/0264166 | A1 | 10/2010 | Moretti | | |

FOREIGN PATENT DOCUMENTS

| | | | |
|---|---|---|---|
| CN | 1075295 | A | 1/1998 |
| CN | 102941970 | A | 2/2013 |
| EP | 0549096 | B1 | 6/1993 |
| GB | 2426506 | A | 11/2006 |
| GB | 2469659 | A | 10/2010 |
| JP | 11222277 | A | 8/1999 |
| WO | 2013021802 | A1 | 2/2013 |
| WO | 2015014828 | A1 | 2/2015 |
| WO | 2015178917 | A1 | 11/2015 |

* cited by examiner

DISPENSING RECEPTACLE AND BAG APPARATUS

CROSS-REFERENCE TO RELATED APPLICATIONS

This application is a Continuation in Part of U.S. patent application Ser. No. 17/623,671 being a National Phase of PCT/IL2020/050903 claiming the benefit of priority from IL Patent Application No. 269047, filed Jan. 9, 2019, the disclosure of which is incorporated herein by reference.

TECHNICAL FIELD

The invention relates to the field of containers, for dispensing therefrom.

BACKGROUND

Non-disposable pressable bottles are used, for dispensing sauces. At the end of the use it must be cleaned for refilling, being disadvantaged.

One known solution is a disposable bag. However, yet, the outer screw-on area of the bottle is exposed and may become dirty when refilled.

There is a long felt need to provide a solution to the above-mentioned and other problems of the prior art.

SUMMARY

A dispensing receptacle, including:

a frame member; and a bag and lid member, for being connected to the frame member, the bag and lid member including a bag.

BRIEF DESCRIPTION OF THE DRAWINGS

Embodiments, features, and aspects of the invention are described herein in conjunction with the following drawings.

DETAILED DESCRIPTION

Figure 1:
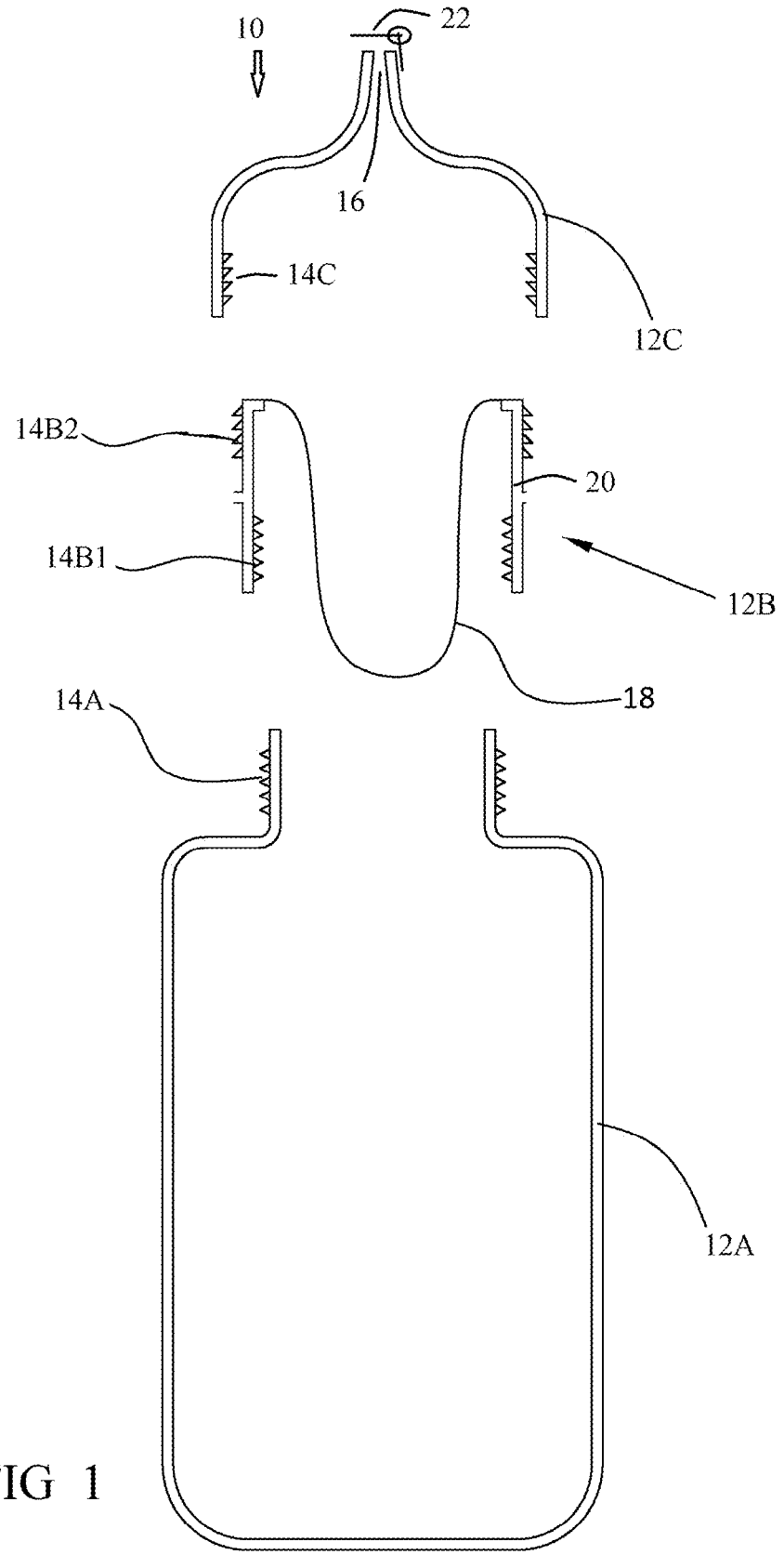
FIG. 1 depicts a dispensing receptacle according to one embodiment of the invention, at a non-assembled state.

FIG. 1 depicts a dispensing receptacle according to one embodiment of the invention, at a non-assembled state.

A dispensing receptacle 10 according to one embodiment of the invention, includes a frame member 12A; a lid member 12C, for dispensing from an orifice 16 thereof; and a bag apparatus 12B including a rack 20 for a bag 18, the rack for being disposed between frame member 12A and lid member 12C.

Frame member 12A is intended to be non-disposable, whereas bag apparatus 12B is intended to be disposable, for separating the content, such as a sauce, from non-disposable frame member 12A, for maintaining frame member 12A clean.

The term "outside directed" thread refers herein to a thread directed towards the environment.

The term "inside directed" thread refers herein to a thread directed towards the inside of the bottle.

Frame member 12A includes an outside directed connecting member 14A such as a thread 14A, for interlacing an inside directed thread 14B1 of rack 20 of bag apparatus 12B; and lid member 12C includes an inside directed connecting member 14C, such as a thread, for connecting to an outside directed connection member 14B2, such as a thread, of rack 20 of bag apparatus 12B.

Bag apparatus 12B includes a bag 18, being irremovable from rack 20 including thread 14B1 and connection member 14B2, for instance being soldered, stuck or cast thereto.

Figure 2:
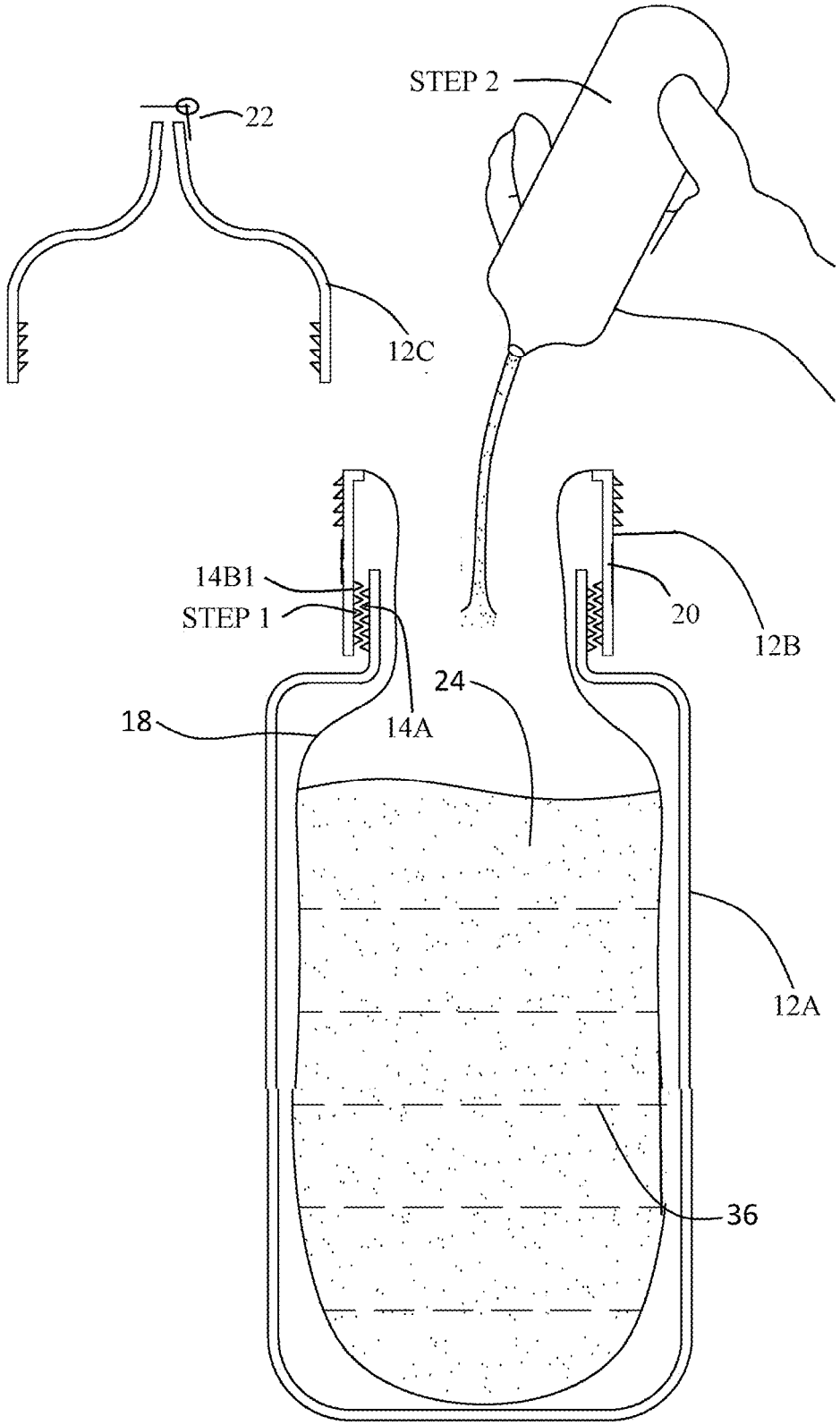
FIG. 2 depicts the first and second steps of using the dispensing receptacle of FIG. 1.

FIG. 2 depicts the first and second steps of using the dispensing receptacle of FIG. 1.

At the first step, the user connects rack 20 of bag apparatus 12B to frame member 12A via thread 14A of frame member 12A being threaded to thread 14B1 of rack 20 of bag apparatus 12B.

At the second step, sauce 24 is poured into bag 18 of bag apparatus 12B.

Figure 3:
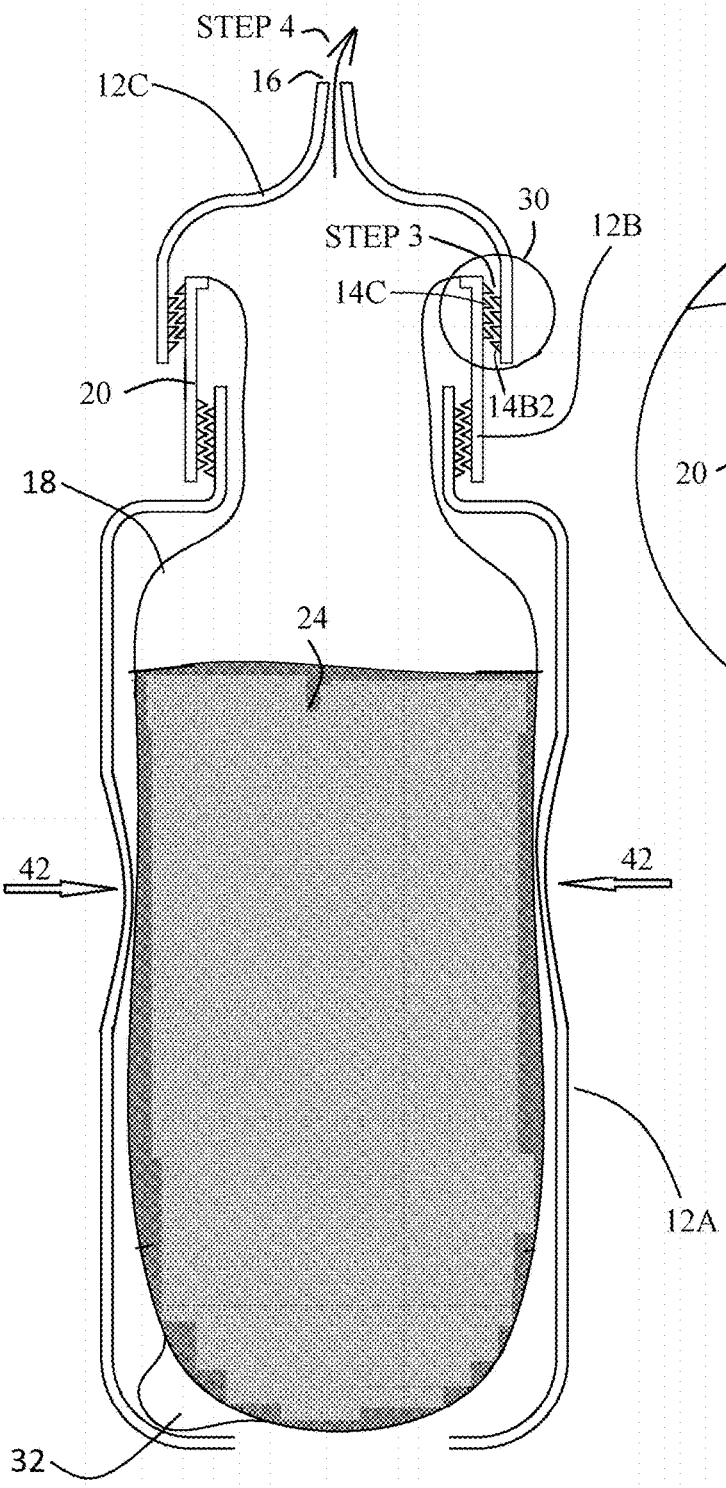
FIG. 3 depicts the third and fourth steps of using the dispensing receptacle of FIG. 1.

FIG. 3 depicts the third and fourth steps of using the dispensing receptacle of FIG. 1.

At the third step, lid member 12C is connected to rack 20 of bag apparatus 12B via connecting members 14C and 14B2.

Frame member 12A is elastic, thus at the fourth step, sauce 24 may be dispensed through an orifice 16 of lid member 12C, by squeezing (42) frame member 12A onto bag 18 to squeeze bag 18.

Figure 4:
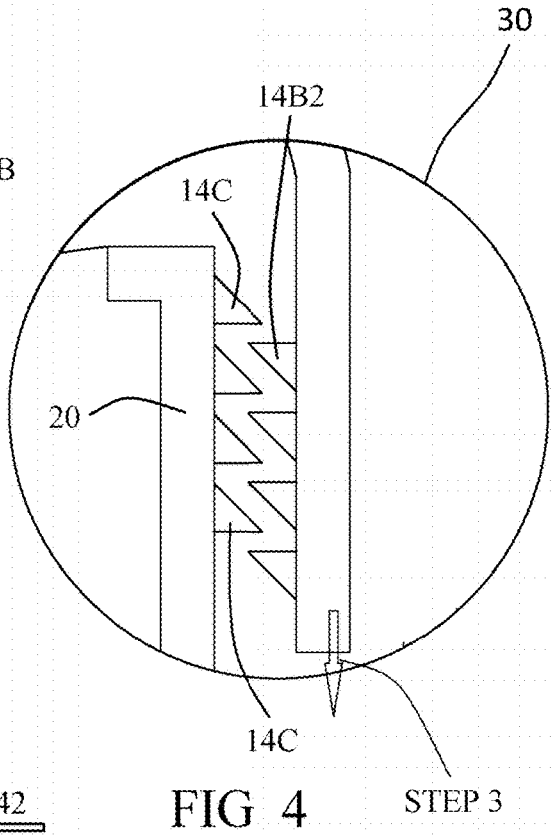
FIG. 4 magnifies a portion of FIG. 3.

FIG. 4 magnifies a portion of FIG. 3.

Connecting members 14C and 14B2 may constitute one-way connecting members, for allowing connecting only, while not allowing separation, for not allowing spilling sauce 24.

This may be applied by connecting members 14C and 14B2 being one-way snapping members, such as being one-directional elastic cogs, for connecting by pressing one-directional cogs 14C and 14B2 one towards the other, rather than by rotating.

Figure 5:
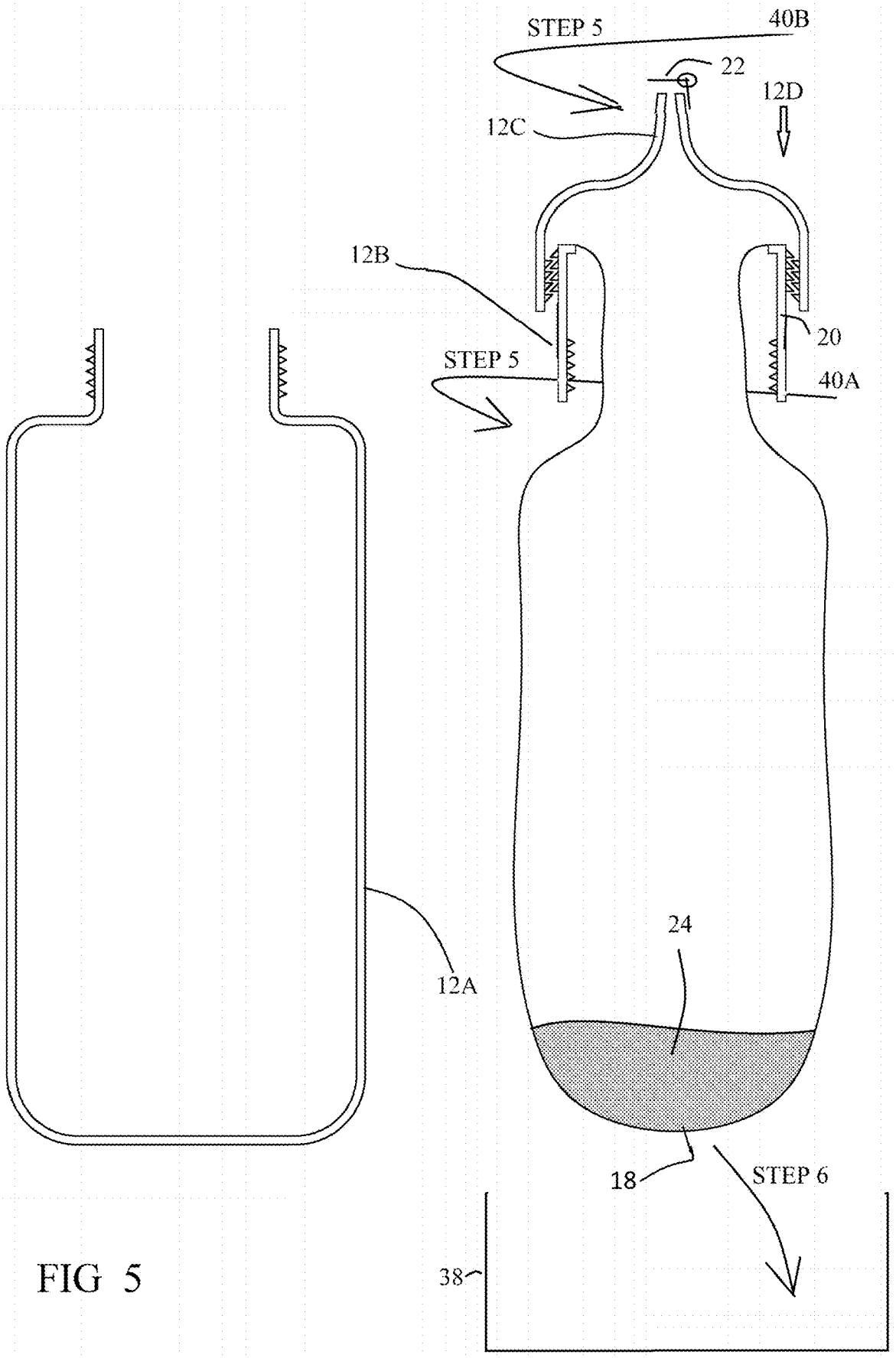
FIG. 5 depicts the fifth and sixth steps of using the dispensing receptacle of FIG. 1.

FIG. 5 depicts the fifth and sixth steps of using the dispensing receptacle of FIG. 1.

At the fifth step, bag apparatus 12B being yet connected to lid member 12C, being the "dirty" elements, are removed from frame member 12A, for throwing them at the sixth step, with the remainder of sauce 24, to the garbage.

The removal is applied by rotating (40A) bag apparatus 12B in relation to frame member 12A, or by rotating (40B) lid member 12C in relation to frame member 12A.

The one-directional elastic cogs 14C and 14B2 provide that rotating 40B of lid member 12C in relation to frame member 12A does not remove lid member 12C from bag apparatus 12B, thus ensures non-spilling of sauce 24 upon the removal from frame member 12A.

Frame 12A is left clean, for connecting thereto a new bag apparatus 12B, as described in FIG. 2.

According to another embodiment, bag apparatus 12B and lid member 12C may be marketed as a single member 12D, which may further contain sauce 24.

Figure 6:
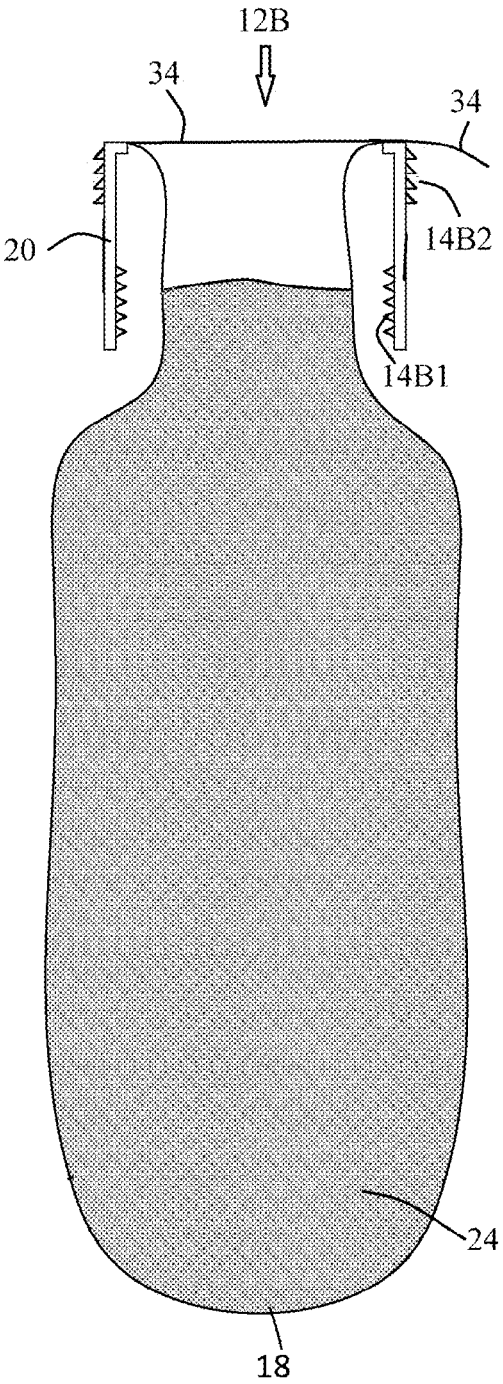
FIG. 6 depicts the bag apparatus of FIG. 1 alone.

FIG. 6 depicts the bag apparatus of FIG. 1 alone.

Bag apparatus 12B may be supplied including sauce 24, by being closed by a reed 34B.

Figure 7:
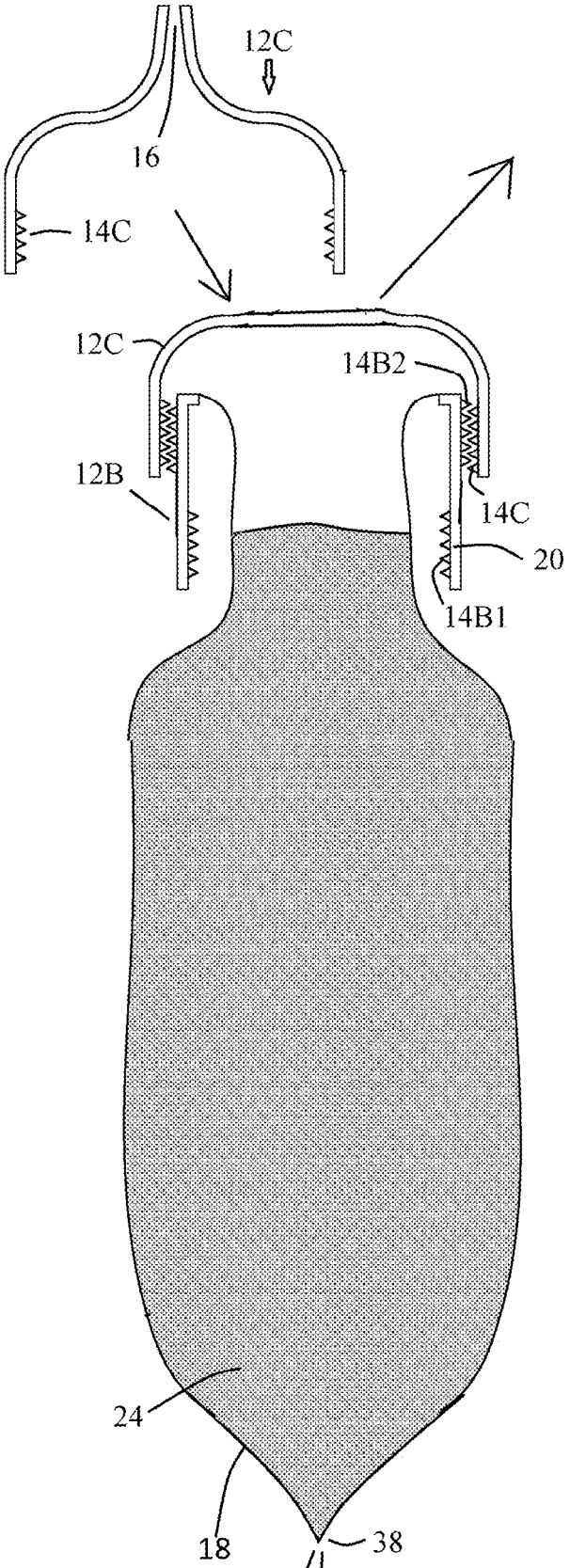
FIG. 7 depicts the bag apparatus of FIG. 1 including the lid, for being supplied including the sauce.

FIG. 7 depicts the bag apparatus of FIG. 1 including the lid, for being supplied including the sauce.

Bag apparatus 12B may be supplied including sauce 24, by being closed by lid member 12C, providing improved closing in relation to reed 34B of FIG. 6, being by dispensing directly from a corner 38 of bag 18 to be punctured.

Connecting members 14B2 and 14C of bag rack 20 may constitute normal threads, for allowing removing lid member 12C lacking an orifice, for replacing it with a lid member 12C including orifice 16, for dispensing therethrough.

Figure 8:
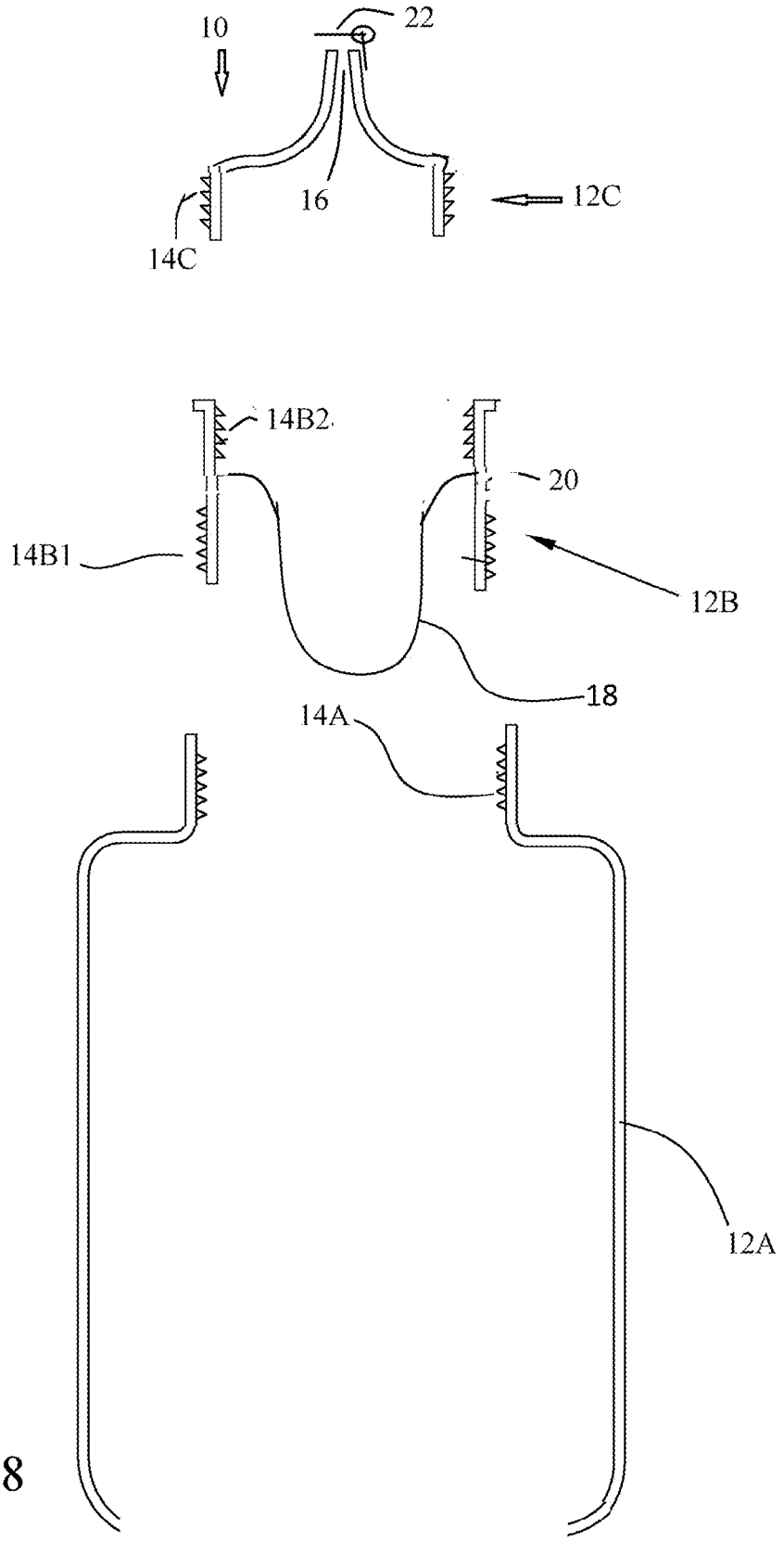
FIG. 8 depicts the dispensing receptacle at the non-assembled state of FIG. 1 according to other embodiments.

FIG. 8 depicts the dispensing receptacle at the non-assembled state of FIG. 1 according to other embodiments.

Each of threads and connecting members 14A, 14B1, 14B2, and 14C may be external or internal, such as of FIG. 8 being different from FIG. 1.

Frame member 12A may be a receptacle as shown in FIG. 1, or a frame only, such as in FIG. 8.

Figure 9:
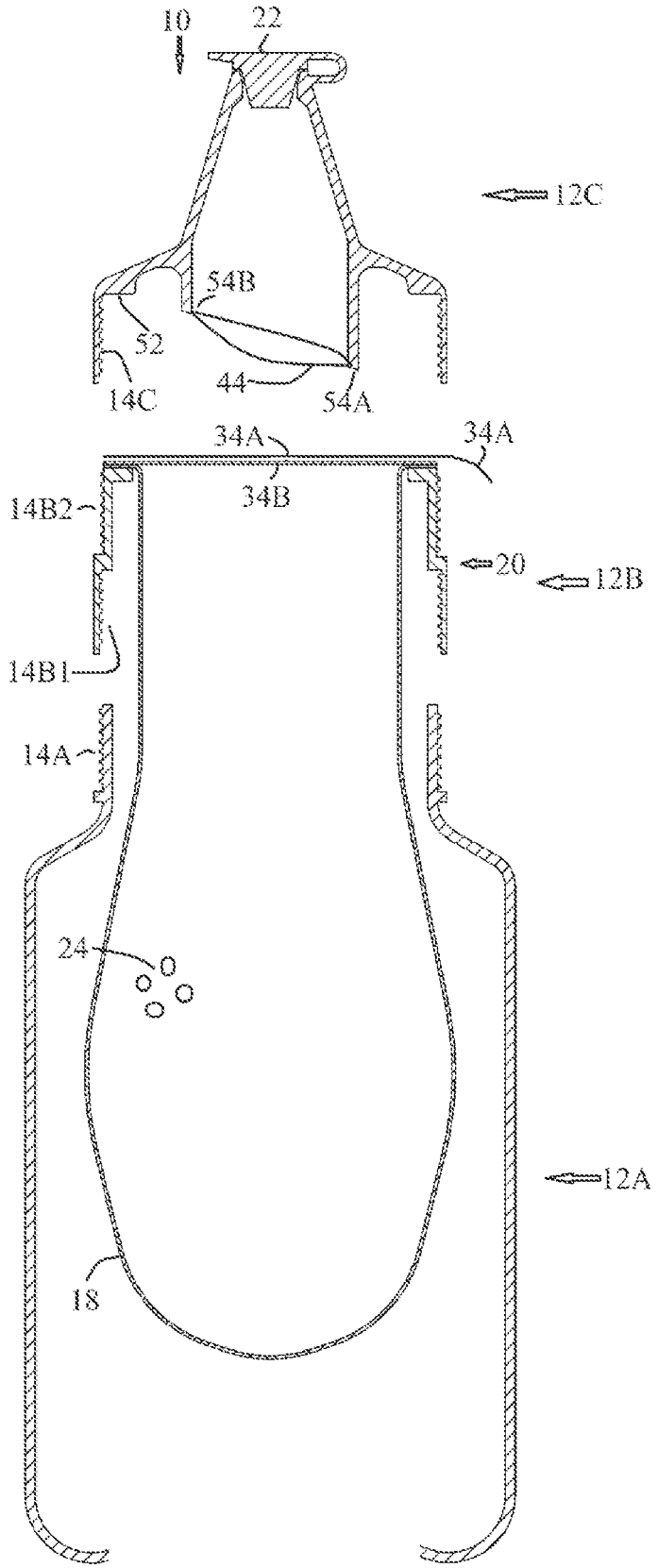
FIG. 9 depicts the dispensing receptacle at the non-assembled state of FIG. 1 according to another embodiment.

FIG. 9 depicts the dispensing receptacle at the non-assembled state of FIG. 1 according to another embodiment.

According to one embodiment, rack 20 of bag apparatus 12B includes reeds 34A and 34B; and lid member 12C includes a punch 44.

Figure 10:
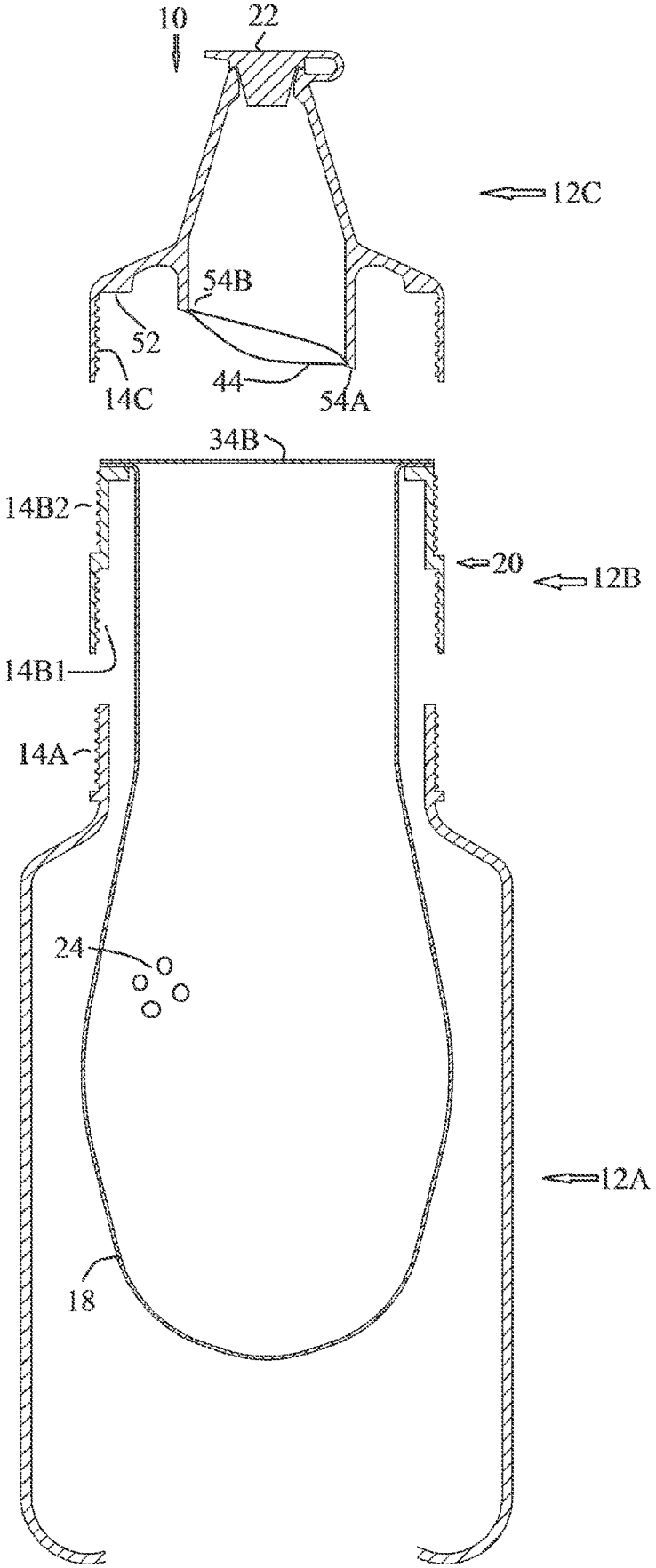
FIG. 10 depicts the lid and the bag apparatus of FIG. 9 upon removing the top reed.

FIG. 10 depicts the lid and the bag apparatus of FIG. 9 upon removing the top reed.

Top reed 34A maintains bottom reed 34B clean and sterile. At the first step, the user removes top reed 34A.

Figure 11:
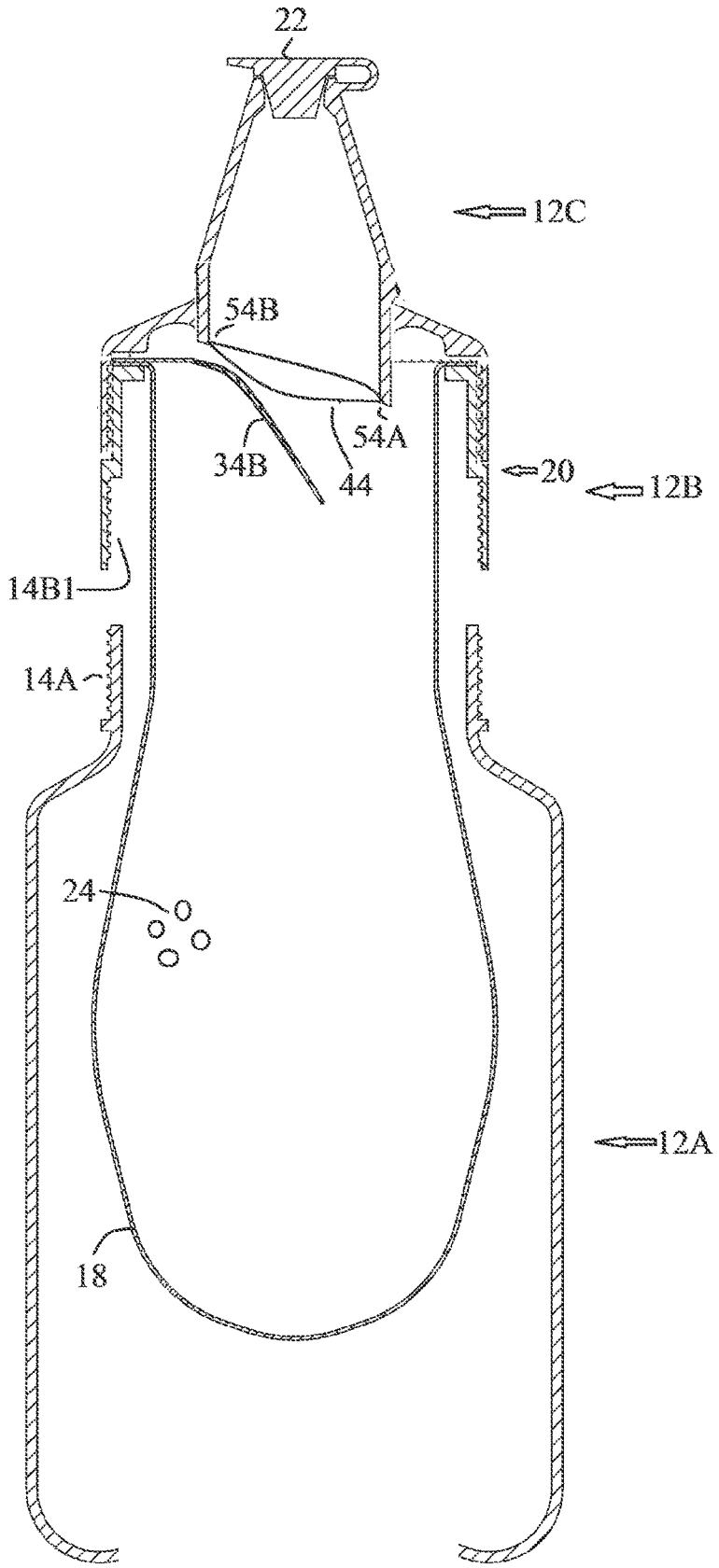
FIG. 11 depicts the lid and the bag apparatus of FIG. 10 upon being attached.

FIG. 11 depicts the lid and the bag apparatus of FIG. 10 upon being attached.

Upon attaching lid member 12C to rack 20 of bag apparatus 12B, punch 44 punches reed 34B. Punch 44 is peripheral, thus then sauce 24 may be dispensed through peripheral punch 44.

Punch 44 is tilted, such that that longest portion 54A is the first to punch.

The shortest portion 54B is too short for punching, thus providing that reed 34B is not completely cut.

Lid member 12C includes a protrusion 52 for pressing the remaining side 53 of reed 34B onto rack 20, for avoiding removal of remainder 53.

In the figures and description herein, the following reference numbers (Reference Signs List) have been mentioned:

Numeral 10 denotes the dispensing receptacle according to one embodiment of the invention;

12A: frame member;

12B: bag apparatus;

12C: lid member;

12D: bag and lid member;

14A,14B1: threads;

14B2,14C: connection members, such as threads, elastic cogs, etc.;

16: dispensing orifice;

18: bag of bag apparatus 12B;

20: rack for hanging bag 18 of bag apparatus 12B;

22: openable cap of lid member 12C;

24: content, such as a sauce;

30: zone;

32: tearing line in bag 18, for removing remainder of content 24;

34A,34B: reeds;

38: corner of bag 18 for being pierced;

36: quantity mark;

38: garbage.

The reference numbers in the claims should not be interpreted as limiting the claims in any form.

What is claimed is:

1. A dispensing receptacle (10), comprising:

a frame member (12A);

a lid member (12C); and a bag apparatus (12B), comprising a rack (20) for being connected between said frame member (12A) and said lid member (12C), said bag apparatus (12B) further comprising a bag (18) being irremovable from said rack (20), said bag (18) for containing content (24) to be dispensed through said lid member (12C), wherein said frame member (12A) and said bag (18) are sufficiently squeezable (42) for squeezing said frame member (12A) onto said bag (18) for squeezing said bag (18), wherein said lid member (12C) comprises a first connecting member (14C) being inside directed, wherein said rack (20) of said bag apparatus (12B) comprises a second connecting member (14B2) being outside directed, for connecting to said first connecting member (14C), and wherein said first connecting member (14C) and said second connecting member (14B2) are configured to allow connection therebetween and to not allow separation therebetween.

2. The dispensing receptacle (10) according to claim 1, wherein said frame member (12A) comprises a first thread (14A) being outside directed, and wherein said rack (20) of said bag apparatus (12B) comprises a second thread (14B1) being inside directed, for connecting said first thread.

3. The dispensing receptacle (10) according to claim 1, wherein said first connecting member (14C) and said second connecting member (14B2) comprise one-directional cogs, for allowing connecting said lid member (12C) to said bag apparatus (12B), and for not allowing separating said lid member (12C) from said bag apparatus (12B) upon said connecting, thereby allowing removing said bag apparatus (12B) from said frame member (12A) and not allowing separating said lid member (12C) from said bag apparatus (12B), thereby said non-allowed separation ensures non-spilling of the sauce (24) upon said allowed removal of said bag apparatus (12B) from said frame member (12A).

4. The dispensing receptacle (10) according to claim 1, wherein said bag (18) is irremovable from said rack (20) of said bag apparatus (12B), via at least one member selected from a group consisting of: sticking, welding, casting.

5. The dispensing receptacle (10) according to claim 1, wherein said rack (20) of said bag apparatus (12B) comprises at least one reed (34B) for closing said bag (18).

6. The dispensing receptacle (10) according to claim 5, wherein said lid member (12C) comprises a hollowed punch (44), for punching said at least one reed (34B) upon lidding said lid member (12C), and for dispensing the sauce (24) through said hollowed punch (44).

7. The dispensing receptacle (10) according to claim 6, wherein at least one reed (34A) comprises a first reed (34B) for being punched by said lid member (12C), and a second reed (34A) for maintaining said first reed (34B) sterile, and for being removed prior to said punching.

8. The dispensing receptacle (10) according to claim 5, wherein said lid member (12C) comprises a protrusion (52), for pressing a side of said at least one reed (34B).

9. The dispensing receptacle (10) according to claim 1, wherein said rack (20) of said bag apparatus (12B) comprises at least one reed (34B) for closing said bag (18).

* * * * *